US005944448A

United States Patent [19]

Williams

[11] Patent Number: 5,944,448

[45] **Date of Patent: *Aug. 31, 1999**

[54] OIL FIELD INSTALLATION WITH MOORING AND FLOWLINE SYSTEM

[75] Inventor: Ian Williams, Aberdeen, United Kingdom

[73] Assignee: Brovig Offshore ASA, Oslo, Norway

[ * ] Notice: This patent issued on a continued prosecution application filed under 37 CFR 1.53(d), and is subject to the twenty year patent term provisions of 35 U.S.C. 154(a)(2).

[21] Appl. No.: 08/770,738

[22] Filed: Dec. 18, 1996

[51] Int. Cl.[6] ..... F16L 1/12; B63B 21/00

[52] U.S. Cl. ..... 405/169; 405/170; 405/171; 114/230; 114/293; 441/3

[58] Field of Search ..... 405/169, 170, 405/171; 166/187, 259, 338, 344, 347, 354, 367; 114/230, 231, 293; 441/3, 4, 5; 137/68.14, 68.15, 149.9, 236.1

[56] References Cited

U.S. PATENT DOCUMENTS

| | | | |
|---|---|---|---|
| 3,300,187 | 1/1967 | Saxe et al. | 114/230 X |
| 3,922,992 | 12/1975 | Wilbourn | 114/230 |
| 4,371,291 | 2/1983 | Morrill et al. | 405/169 |
| 4,587,919 | 5/1986 | Loire et al. . | |
| 5,064,329 | 11/1991 | Brenna | 441/5 X |
| 5,145,429 | 9/1992 | Stoddart et al. | 441/4 |
| 5,178,087 | 1/1993 | O'nion et al. | 114/293 X |
| 5,316,509 | 5/1994 | Boatman et al. | 114/293 X |
| 5,380,229 | 1/1995 | Korsgaard | 114/293 X |
| 5,392,853 | 2/1995 | Toon | 166/187 |
| 5,564,957 | 10/1996 | Breivik et al. | 114/230 X |
| 5,676,083 | 10/1997 | Korsgaard | 114/230 |
| 5,699,822 | 12/1997 | Bodhaine | 137/68.15 |

FOREIGN PATENT DOCUMENTS

| | | | |
|---|---|---|---|
| 407662 | 1/1991 | European Pat. Off. . | |
| 1238542 | 7/1971 | United Kingdom . | |
| 1384983 | 2/1975 | United Kingdom . | |
| 1403739 | 8/1975 | United Kingdom . | |
| 1403740 | 8/1975 | United Kingdom . | |
| 1404775 | 9/1975 | United Kingdom . | |
| 1492111 | 11/1977 | United Kingdom . | |
| 1514713 | 6/1978 | United Kingdom . | |
| 1595045 | 8/1981 | United Kingdom . | |
| 2069955 | 9/1981 | United Kingdom | 114/293 |
| 2173160 | 10/1986 | United Kingdom . | |
| 2192592 | 1/1988 | United Kingdom . | |
| 2244463 | 12/1991 | United Kingdom . | |
| 2250253 | 6/1992 | United Kingdom . | |
| 93/13976 | 7/1993 | WIPO . | |

*Primary Examiner*—David J. Bagnell
*Assistant Examiner*—Jong-Suk Lee
*Attorney, Agent, or Firm*—Ratner & Prestia

[57] ABSTRACT

A seabed flowline is connected to a substantially conventional tanker serving as a floating storage facility by a system comprising a three-leg mooring and a flexible riser. The mooring comprises anchors connected by anchor risers to a common node, and a mooring pendant extending from the node to the tanker. The flexible riser comprises a flexible rubber hose extending from the seabed to the tanker. The hose has a top section secured along part of the mooring pendant, and an intermediate section provided with buoyancy and restrained by a tether to maintain it clear of the anchor risers.

11 Claims, 7 Drawing Sheets

OIL FIELD INSTALLATION WITH MOORING AND FLOWLINE SYSTEM

FIELD OF THE INVENTION

This invention relates to a mooring and flowline system for use in floating facilities for handling petroleum and petroleum products in an oilfield installation. The system is particularly, but not exclusively, applicable to the mooring and loading of floating export storage in production wells or wells undergoing extended well testing.

BACKGROUND TO THE INVENTION

Production from offshore wells was originally exported ashore by subsea pipeline, which requires a very large capital expenditure. More recently there has been a move to exploiting more marginal fields by the use of a floating production platform in conjunction with a floating storage facility from which oil is exported periodically by tanker. Commonly, the floating storage facility has been provided by conversion of an existing tanker. Such arrangements have worked well, but there is a continuing need for a substantial reduction in installation costs in order to improve the economics of marginal field production, and in order to make extended well testing more economically feasible.

Tanker conversions used hitherto have required extensive conversion. In some cases a turret mooring is used which includes a rotary oil flowline joint, and this requires major structural work on the tanker in addition to the complex mooring turret. In other cases, a flexible riser to the tanker has been used but has required large quick connect-disconnect (QCDC) valves with a physical size and weight requiring installation outboard of the tanker bow on a specially installed and relatively large structure.

SUMMARY OF THE INVENTION

An object of the present invention is to provide an improved mooring and flowline system for use in an oil installation which is simple and economical to install. It is also an object of the invention to provide a system which enables conventional tankers to be used as floating storage with a minimum of structural alteration.

Accordingly, the present invention provides a mooring and flowline system comprising:

- means for mooring a floating storage and/or production vessel to the seabed, and a flowline for connection to a producing well or facility;
- the mooring means comprising at least two anchors in the sea bed, a respective anchor riser extending from each of the anchors, each of the anchor risers having one end secured to its anchor and the other end secured to a common mooring node member, and mooring pendant means extending from the node member for connection, in use, to the vessel;
- the flowline comprising a seabed flowline extending from the direction of the well or facility into the vicinity of the mooring means, and a flexible riser flowline extending from the seabed flowline to the vessel;
- and in which the flexible riser flowline is a continuous conduit without rotational couplings and has part of its length secured alongside at least part of the mooring pendant means.

Preferably, there are at least three anchors in an angular array, three anchors at mutual 1200 spacings being particularly preferred.

The flowline riser is suitably held clear of the anchor risers and node member by providing a portion of the flowline riser with flotation and by tethering the same portion to restrict sideways movement.

Preferably also, there is no swivel between the anchors and the vessel; the node member may be a plain ring, shackle or plate.

The mooring pendant may comprise two parallel chains, one passing over each bow of the vessel.

Preferably, the vessel is a tanker.

In a particularly preferred form the invention, which allows a conventional tanker to be utilized as the storage vessel with a minimal amount of conversion, the parallel chains are brought inboard of the tanker to standard chain stoppers or to remotely controlled release stoppers, the flexible riser flowline is brought inboard of the tanker over a chute to have its inboard end lying along the tanker deck, and quick connect/disconnect valve means are located on the tanker deck between said flowline riser inboard end and a tank manifold of the tanker.

DESCRIPTION OF DETAILED EMBODIMENT

An embodiment of the invention will now be described, by way of example, with reference to the drawings, in which.

Figure 1:
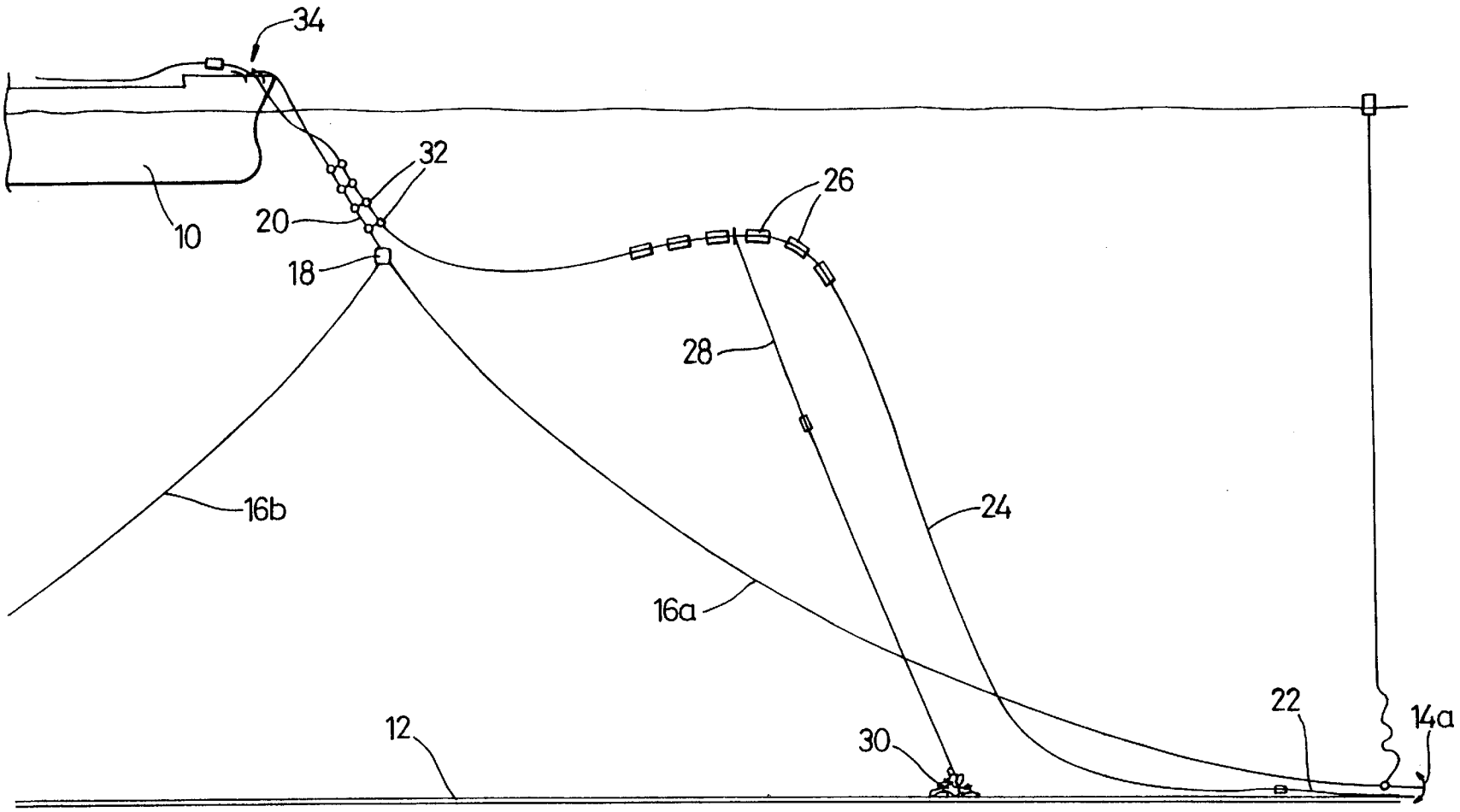
FIG. 1 is a schematic side view of one embodiment of the invention in use with a storage tanker.
Figure 2:
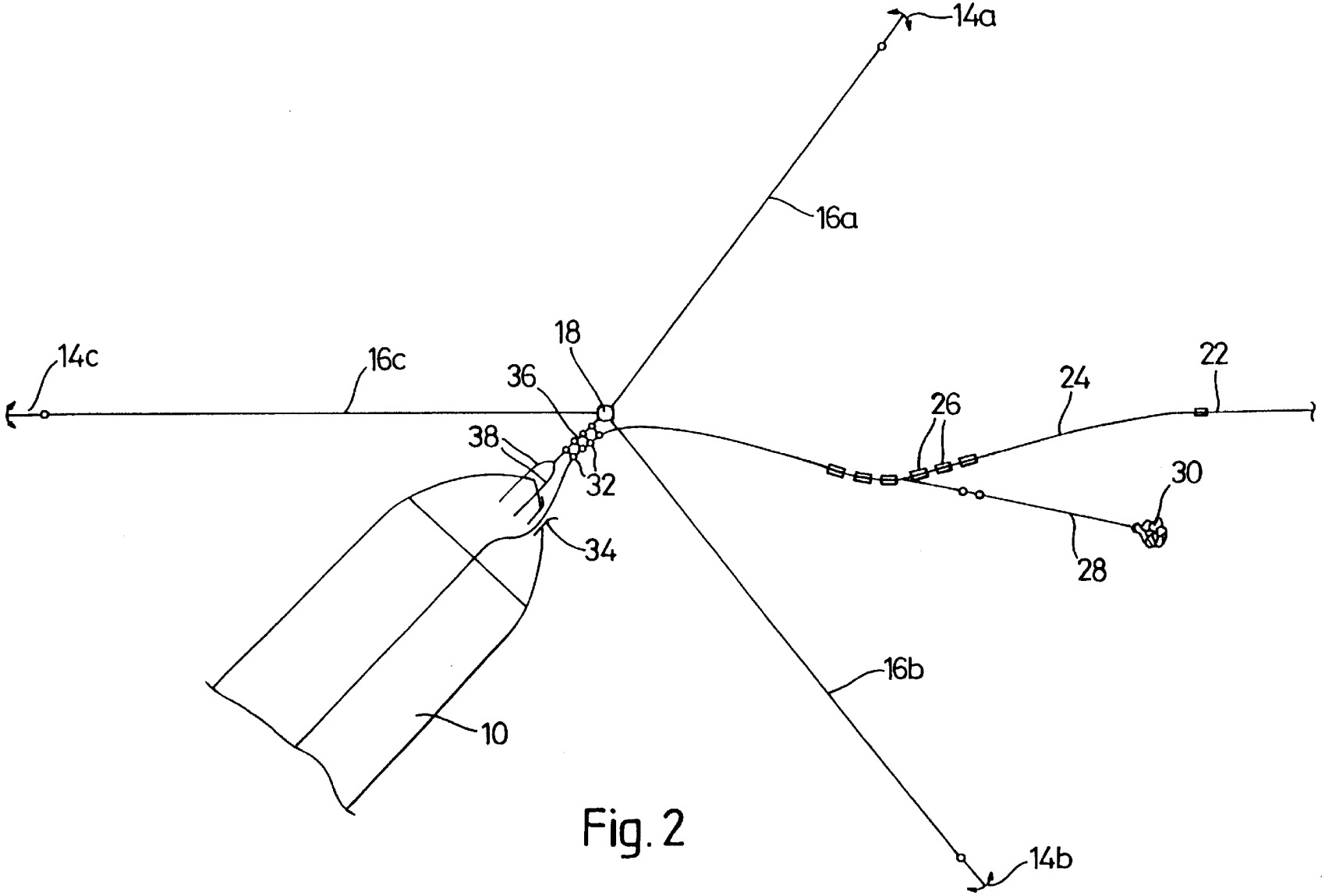
FIG. 2 is a plan view corresponding to FIG. 1.
Figure 3:
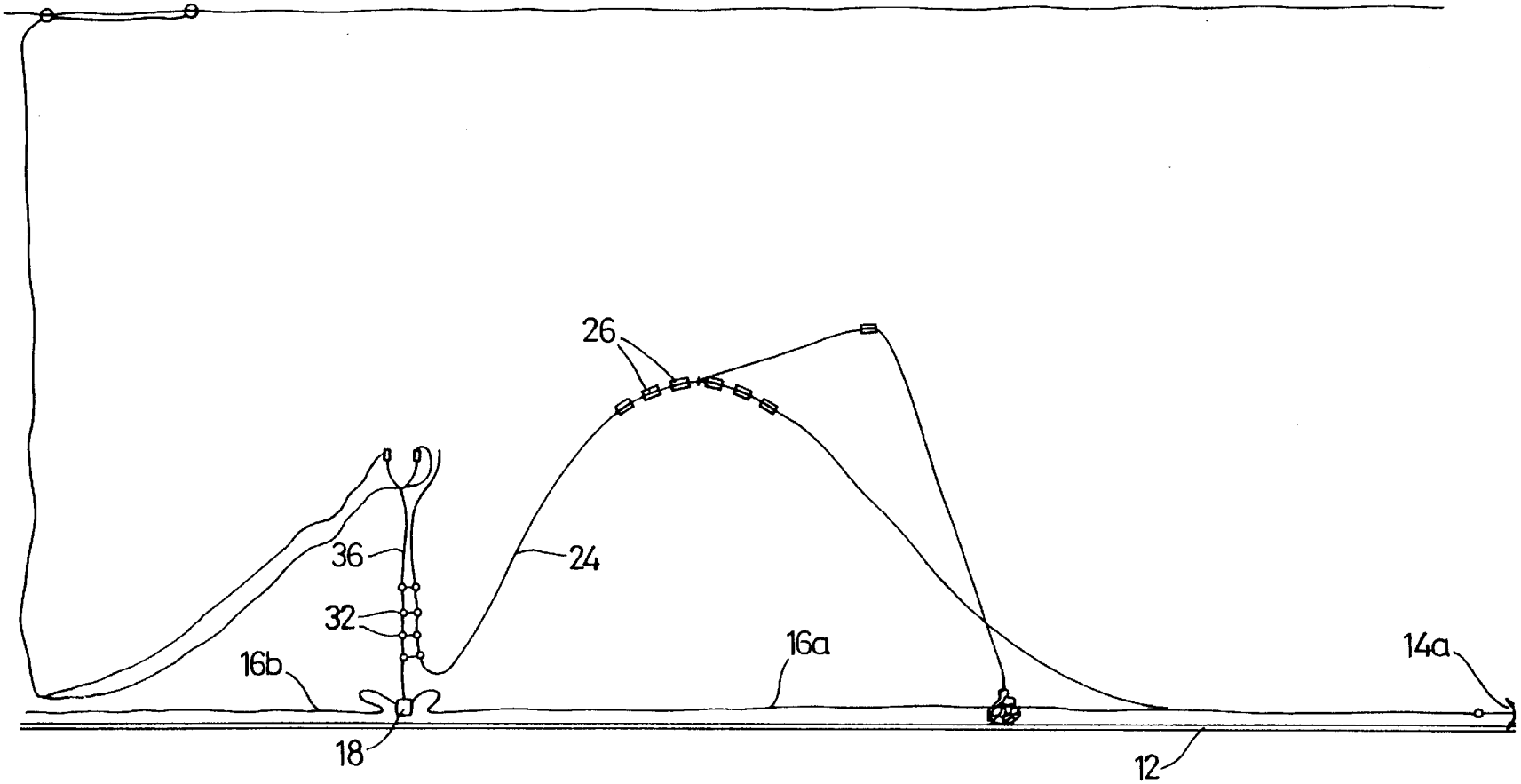
FIG. 3 is a view similar to FIG. 1 but showing the system out of use with the storage tanker removed.

Referring particularly to FIGS. 1 and 2, a floating storage tanker 10 is anchored to the sea bed 12 by means of a three-leg anchor system comprising anchors 14*a*, 14*b*, 14*c* connected by risers 16*a*, 16*b*, 16*c* to a node 18, from which a mooring pendant 20 is secured to the tanker 10. The mooring is in the vicinity of a floating production platform (FPF) (not seen in the drawings) from which oil is transferred via a flowline.

The flowline comprises a seabed portion 22 and a flexible riser 24. The riser 24 has a mid portion which is provided with flotation collars 26 and is restrained by a tether 28 secured to a clump weight 30. As seen in FIG. 2, the mooring is set such that a 120° angle may be presented towards the FPF with the flowline approaching along the bisector of this angle. This geometry, together with the flotation of the collars 26 and the restraint by the tether 28 maintains the riser 24 clear of conflict with the mooring node 18.

The upper part of the riser 24 is secured along the mooring pendant 20 by spaced double collars 32 and then taken aboard the tanker 10 via a chute assembly indicated at 34.

Figure 4:
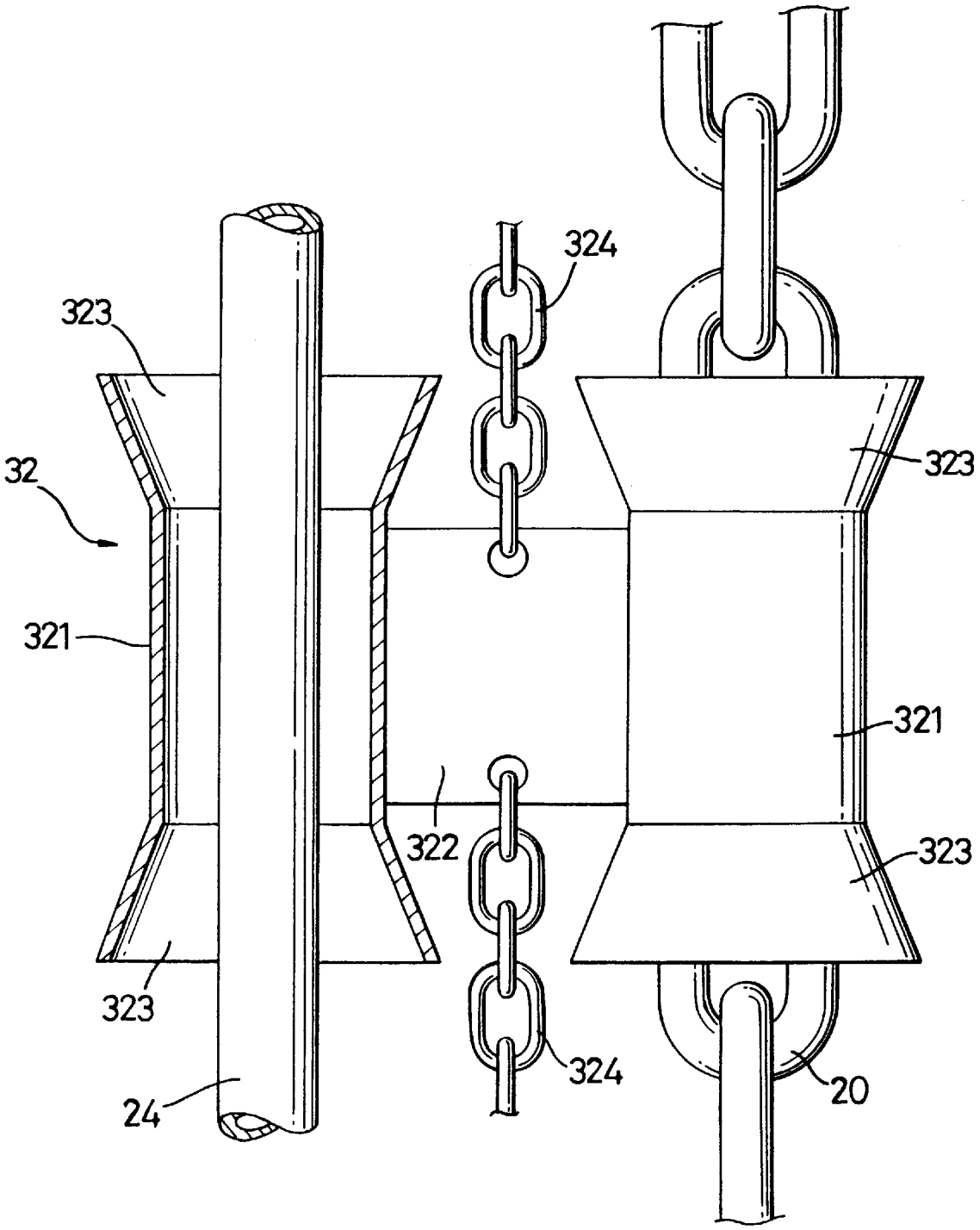
FIG. 4 shows a detail of the system of FIGS. 1 to 3.

FIG. 4 shows in more detail one suitable arrangement of the double collars 32. Each of the double collars 32 comprises a pair of pipe sections 321 joined by a rigid web 322 and having flared entry and exit sections 323, and may suitably be cast or fabricated in steel. The collars 32 can be spaced along the mooring pendant 20 and riser 24 by being hung on spacer chains 324.

The anchors 14*a*, 14*b*, 14*c* may be any suitable form of conventional mooring anchor. Each of the anchor risers 16*a*, 16*b*, 16*c* has at least its on-bottom length constituted by chain. For water depths up to about 75 meters, the chain can be continuous to the node 18.

In greater water depths up to about 150 meters, it is preferred to have the on-bottom section of chain but the catenary section of wire. The use of wire has several advantages. Principally, it reduces the weight which has to be lifted when the tanker is connecting to the system, as is discussed more fully below. It also makes the departure angle of the riser 16 from the node 18 nearer the horizontal, which increases the horizontal stability of the system, and simplifies stowage on the vessel used to deploy the system. Where wire is used for the catenary section, it is desirable to have the final 30 meters or so nearest the node 18 of chain, to reduce the risk of kinking of the wire.

In water depths greater than about 150 meters, the wire may be replaced by synthetic fibre rope, for the same reasons.

The node 18 may take any suitable form which connects together the three risers 16 and the pendant 20 with adequate mechanical strength. A suitably sized master ring may be used, or a triangular plate arrangement, together with conventional shackles. No swivel is incorporated in the node 18.

Figure 5:
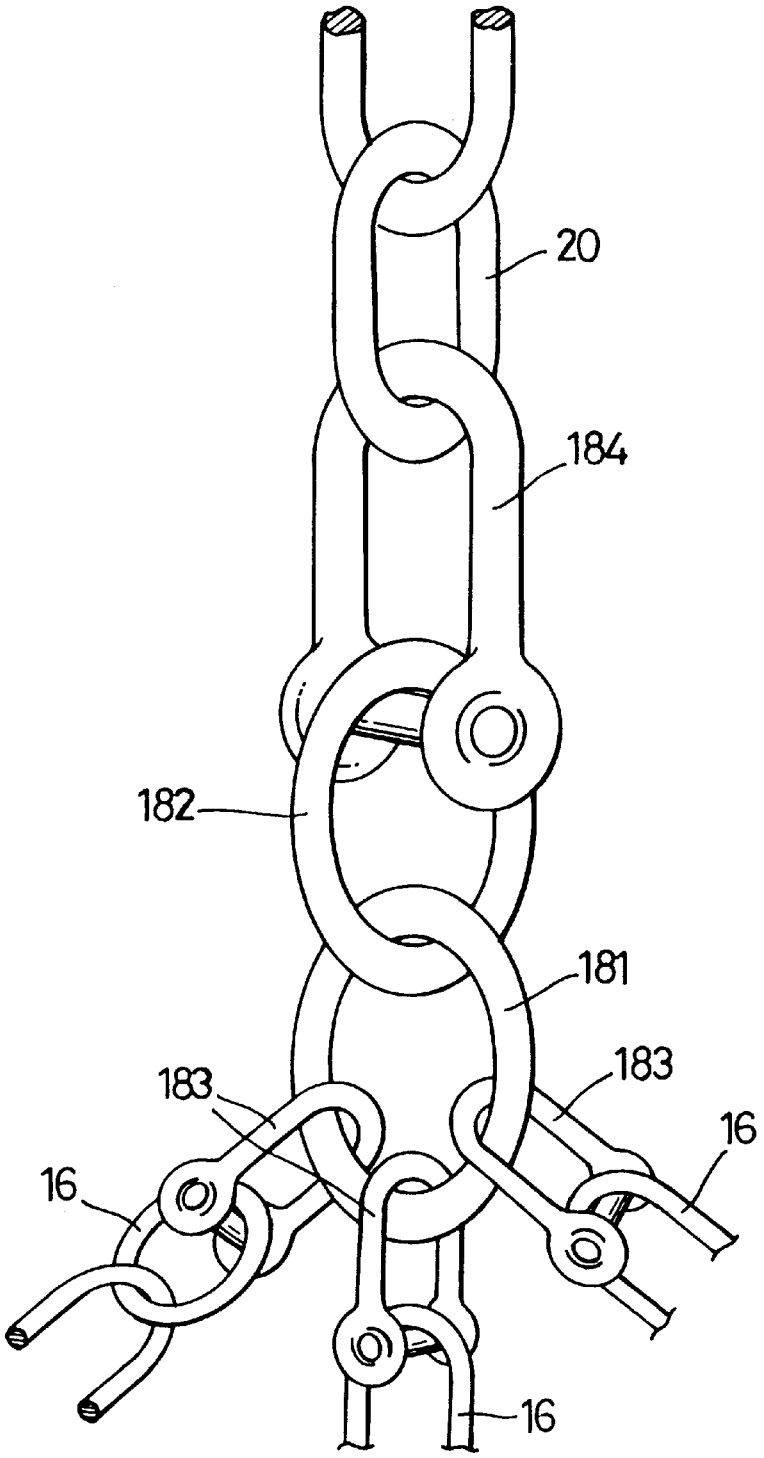
FIG. 5 shows one form of node used in the system.

One example of node is shown in FIG. 5 in the form of a double ring 181, 182. The three risers 16 are connected by shackles 183 to the ring 181, and the pendant 20 is connected by a shackle 184 to the ring 182.

In some circumstances there may be an advantage in reducing the weight of the node and the catenary sections, and to this end buoyancy (not shown) may be incorporated in the node 18 or in the anchor risers 16 adjacent the node 18.

In a typical installation, the tanker 10 is a segregated ballast tanker of 600,000 to 700,000 bbl capacity and the mooring is designed to hold the node 18 at a depth of 20 to 30 meters, and thus up to about 15 meters beneath the tanker hull. In these circumstances, the mooring pendant 20 will require to be of the order of 40 to 50 meters in length.

The preferred form for the mooring pendant 20 comprises a single large-size chain 36 extending from the node 18 and connected to a pair of chafe chains 38. For the same order of size of the tanker 10, it is suitable to have the chains 38 of 76 mm size, which will fit the standard (Oil Companies International Marine Forum) recommended tongue-type bow stoppers fitted to most tankers of this size. This arrangement simplifies the node design and minimizes modification to the tanker.

Figure 6:
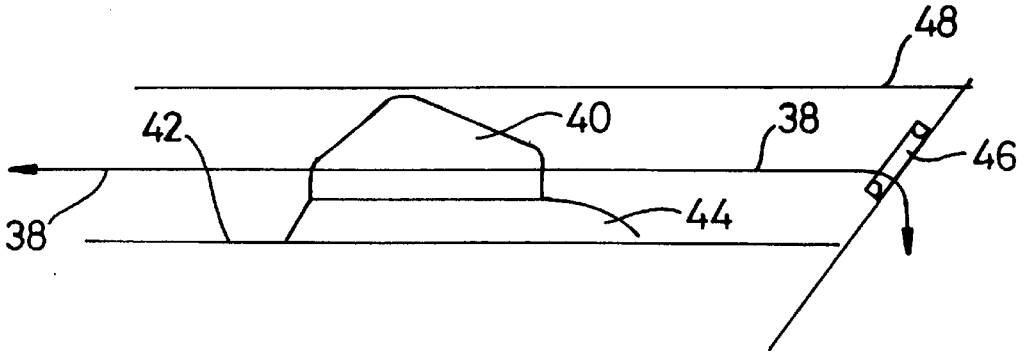
FIG. 6 is a schematic side view of a tanker bow illustrating a suitable arrangement for use in present invention.
Figure 7:
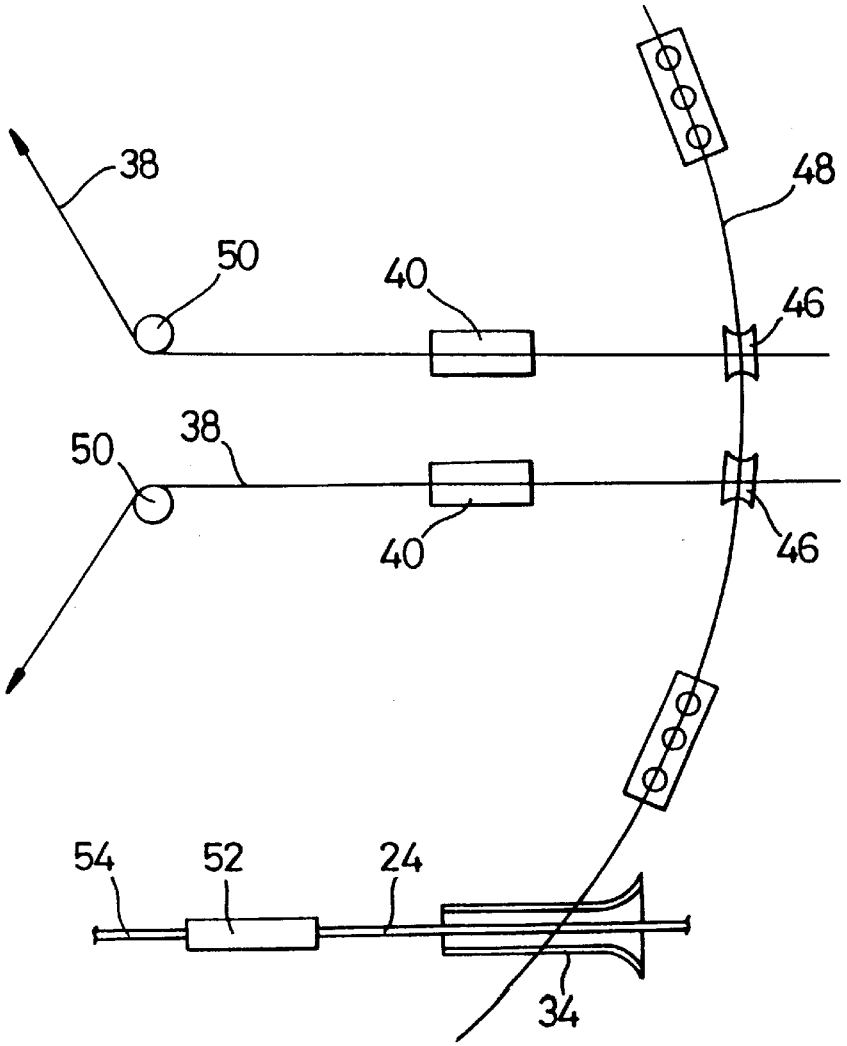
FIG. 7 is a plan view corresponding to FIG. 6.

Referring to FIGS. 6 and 7, there is shown a suitable tanker bow installation which requires a minimum of modification from standard shipping practice. Each of the chains 38 is held by a tongue-type bow stopper 40 raised above the foc'sle deck 42 on a seating 44. The incoming chain 38 passes through port and starboard fairlead 46 in the bow bulwark 48 each of the fairleads aligned with the respective bow stopper 46, and the inboard end of the chain is passed to a winch windlass via a pedestal fairlead 50.

Figure 8:
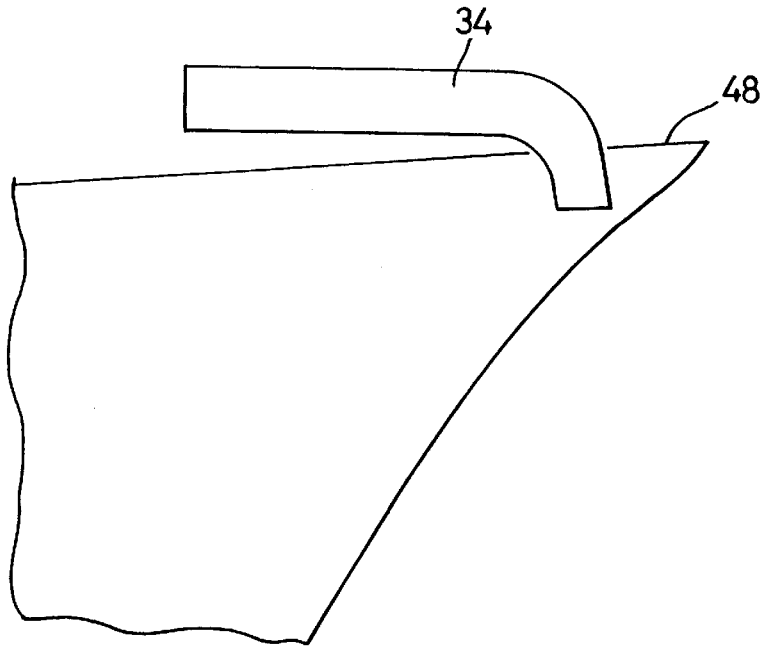
FIG. 8 is a side view of a chute seen in FIG. 7.

As will be seen from FIGS. 7 and 8 the chute 34 is simple structure providing an arcuate guide on two axes for the flexible riser 24. It is not necessary to have any guidance for the riser 24 below bulwark level, since the riser will be spaced away from the remainder of the vessel's hull by the considerable flare of the foc'sle bulwarks in relation to the lower part of the hull.

Figure 9:
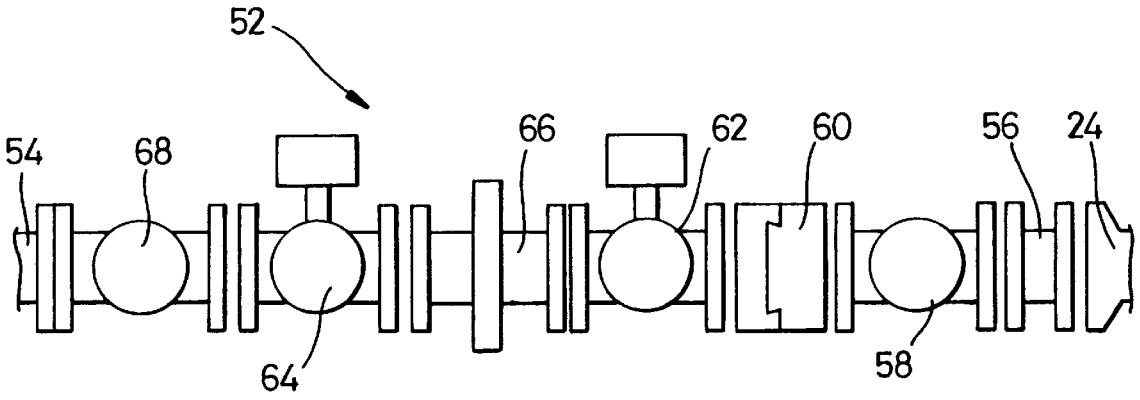
FIG. 9 illustrates in more detail part of the oil line seen in FIG. 7.

FIG. 7 also indicates the position on the foc'sle deck of valve gear generally designated at 52. The valve gear 52 is shown in more detail in FIG. 9, in which it will be seen that the flexible riser 25 is connected to a deck line 54 via a spool piece 56, a manually operated ball valve 58, a breakaway coupling 60, first and second hydraulically operated ball valves 62 and 64 between which is located a hydraulically operated emergency release collar 66, and an emergency shutdown valve 68. The breakaway coupling 60 is suitably a GALL-THOMSON breakaway coupling which has bolts which shear at a predetermined axial load, the chute 34 ensuring that the load on the coupling is always axial. The GALL-THOMSON breakaway coupling also includes a double-acting disc valve which seals both sides of the coupling as the unit breaks apart. The manually operated ball valve 58 would be used to close the connection in normal disconnection routines. The hydraulically activated release system comprising the components 62, 64, 66 can be operated remotely, for example, from the bridge of the vessel, where it is decided to make an emergency disconnection of the tanker. The emergency shutdown valve 68 is included to provide shutdown of flow without disconnection and would normally be part of the tanker's equipment even if not located close to the release system.

The deck line 54 is most conveniently connected with the vessel tankage via the normal midships tank manifold, and thus the deck line 54 must extend from the bow area to the midships of the vessel. The line 54 can be provided in the form of steel tubing fixed to the conventional tube racking, or as a further length of hose of the same nature as the riser 24.

The riser 24 must be a flexible hose with sufficient dynamic properties to accept movement of the ship's bow and movement of the touchdown point at the bottom of the catenary. A suitable hose is a fully bonded rubber hose, preferably MANULI fully bonded rubber hose of 6" or 8" size by Manuli Rubber Industries of Ascoli Piceno, Italy.

It will be appreciated from the foregoing description that the mooring arrangement of the present invention does not include a fluid swivel. There will therefore be a restriction on the number of turns the vessel can make, since turning full circle will effectively twist the fluid riser and the chafe chains round each other. Contrary to previous practice, the present inventors believe that this is not a real restriction in a floating production situation. It is believed that the weather patterns actually found in practice may make a vessel do complete turns, but there would be more than sufficient lighter weather periods when the vessel could be pulled back around to take a turn out. The embodiment described, using MANULI fully bonded rubber hose, is capable of at least one and one-half turns, and up to three turns, without adversely affecting mechanical integrity and safety.

It is currently accepted practice to have a tug on permanent standby in these situations. This is for three main reasons: emergency towing if the tanker suffers a power blackout, support for the tanker when connecting and disconnecting, and as a guard vessel to stop passing fishing and other craft from going between the rig and the tanker.

The mooring system of the present invention allows a large tug to be dispensed with as the standby vessel, since the mooring system provides a redundant system in the event of a blackout, and the other roles could be filled by a much smaller vessel such as an AHTS (Anchor Handling/Tug/Supply) vessel.

Because it uses standard anchors and anchor cable, a normal anchor handling tug vessel can install the system. Initially each anchor would be laid using DGPS to a 10 meter tolerance. This has been achieved in depths in excess of 500 meters so is not anticipated a problem in any depth of less than 150 meters, even without European Differential Global Positioning Satellite (DGPS) accuracy.

Each anchor is laid in turn, the cables run back to a common point; each cable as it is laid is buoyed off on a pendant wire. Insurance tensioning of the system can be done using the bollard pull of the tug. When all three have been laid the anchor handler recovers all three cables over the stern roller. This requires a fairly large anchor handler with a winch of at least 250 tonne pull, and a bollard pull of about 150 tonnes. These are readily available in most areas of the world on the spot market. The node point is assembled and deployed over the side, lowering the node point to the seabed using the chafe chains, then their pendant wires, and finally polyprop rope. The main polyprop would then be buoyed off, a messenger attached and a marker buoy at the end of that.

When the tanker is coming on to location, the support vessel recovers the messenger, and passes it across to the tanker using a compressed air rocket gun. The tanker pulls in on the messengers, then the polyprop ropes, then the pendant wires, and starts to heave in the chafe chains, securing them in the bow stoppers. The windlasses to be used for this will require to be in good condition, and both to be operating at once. But the typical 40 tonne pull of ships' windlasses should be more than sufficient for this application, as the node point is only being brought to about 25 or 30 meters below the surface, and hence 10 to 15 meters below the ship's hull.

In the event of disconnection, it is no different from a tanker disconnecting from a buoy: release the chafe chains from the bow stoppers, and lower them over the bow as the vessel moves away. The assistance of a support tug on site would make this operation feasible even in bad weather, by providing control of the bow and using the ship's main engines to keep slack on the chafe chains for releasing from the tongues.

Recovery of the system would be by chasing each of the anchor legs back to the anchor and lifting from that point; or alternatively to disconnect at the node point and heave in on the AHTS, working back to the anchor and lifting it up on deck.

It will be seen that the present invention provides a mooring and flowline system which is of a surprisingly simplified nature in comparison with conventional systems for similar purposes and which uses simple, conventional, and readily available components in the novel manner.

Although described with particular reference to the transfer of oil from a producing well to a storage vessel, the application is equally applicable to other situations involving a mooring and a flowline, for example for mooring a floating production vessel and exporting its production via the flowline to some other facility. The system may also be used in supplying fuel products, for example to position a product tanker to supply fuel by flowline to a location ashore.

I claim:

1. An oilfield installation comprising a floating vessel, means for mooring said vessel, and a flowline fluidly connecting said vessel to a seabed facility;

the mooring means comprising at least two anchors in the seabed, a respective anchor riser extending from each of the anchors, each of the anchor risers having one end secured to said anchor and the other end secured to a common mooring node member disposed: (1) at all times during mooring of, (2) at a location spaced beneath, and (3) outboard of, said vessel, and elongated mooring pendant means having one end secured to the node member and the other end connected directly to the vessel;

the flowline comprising a seabed flowline extending from the direction of said facility into the vicinity of the mooring means, and a flexible riser flowline extending from the seabed flowline over the side of, and aboard, the vessel; and in which the flexible riser flowline is a continuous conduit without rotational couplings and has part of the length of the flexible riser flowline secured alongside at least part of the mooring pendant means.

2. The installation according to claim 1, in which there are at least three anchors in an angular array.

3. The installation according to claim 2, in which there are three anchors at mutual 120° spacings.

4. The installation according to claim 1, in which the riser flowline is of fully bonded reinforced rubber construction.

5. The installation according to claim 1, in which a portion of the flexible riser flowline is provided with flotation means, and in which a tether connects said portion to the seabed.

6. The installation according to claim 1, in which there is no swivel between the anchors and the vessel.

7. The installation according to claim 6, in which the node member comprises at least one plain ring connected to the anchor risers and to the mooring pendant means by respective shackles.

8. The floating vessel of the installation in accordance with claim 1 further comprising stopper means for releasably securing the mooring pendant means and fairlead means for receiving the mooring pendant from out board and guiding the mooring pendant to said stopper means, a petroleum conduit terminating in quick connect/disconnect valve means, and a chute for receiving and guiding a flexible riser which is adapted to be disposed, in use, between said valve means and a location outboard of said fairlead means, said chute providing a guide surface which permits a hose thereon to curve both horizontally and vertically and to pass clear of the bow of the vessel.

9. The vessel according to claim 8, said vessel being a tanker ship with said chute and said valve means position on the forecastle of the ship, and in which the mooring pendant comprises a twin chain pendant, the fairlead means comprises port and starboard fairleads for the twin chain pendant, and said stopper means comprises port and starboard tongue stoppers.

10. An oilfield installation comprising a floating vessel, means for mooring said vessel, and a flowline for connection to a seabed facility;

the mooring means comprising at least two anchors in the seabed, a respective anchor riser extending form each of the anchors, each of the anchor risers having one end secured to said anchor and the other end secured to a common mooring node member disposed at a location spaced beneath said vessel, and elongated mooring pendant means having one end secured to the node member and the other end connected directly to the vessel;

the flowline comprising a seabed flowline extending from the direction of said facility into the vicinity of the mooring means, and a flexible riser flowline extending from the seabed flowline to the vessel;

and in which the flexible riser flowline is a continuous conduit is without rotational couplings and has part of the length of the flexible riser flowline secured alongside at least part of the mooring pendant means;

the mooring pendant means comprising two parallel chains, each of the chains passing over a respective side of the bow of the vessel to chain stoppers on the vessel;

and in which the flexible riser flowline passes inboard of the vessel over a chute to have all inboard end of the flexible riser flowline lying along the vessel deck, and quick connect/disconnect valve means are located on the vessel deck between said flexible riser flowline inboard end and a deck line of the vessel.

11. The installation according to claim 10, in which said valve means includes a self-sealing breakaway coupling.

* * * * *